US005226302A

United States Patent [19]

Anderson

[11] Patent Number: 5,226,302

[45] Date of Patent: Jul. 13, 1993

[54] SIX-WAY SELF-ADJUSTING LOCK FOR USE ON TRUCK STORAGE BOXES AND THE LIKE

[75] Inventor: Victor R. Anderson, Trumbull, Conn.

[73] Assignee: Loctec Corporation, Newtown, Conn.

[21] Appl. No.: 685,286

[22] Filed: Apr. 15, 1991

[51] Int. Cl.[5] ..... B65D 55/14

[52] U.S. Cl. ..... 70/159; 70/461; 292/341.18; 292/DIG. 55; 292/DIG. 60; 411/85; 411/107

[58] Field of Search ..... 70/159, 461; 292/DIG. 14, 341.18, 341.19, DIG. 55, DIG. 60; 411/84, 85, 112, 113, 107

[56] References Cited

U.S. PATENT DOCUMENTS

| | | | |
|---|---|---|---|
| 2,681,245 | 6/1954 | Ackermans | 292/341.19 |
| 3,339,215 | 9/1967 | Flood | 411/424 X |
| 3,346,286 | 10/1967 | Wescott | 411/424 X |
| 3,753,316 | 8/1973 | Savarieau et al. | 292/201 X |
| 4,232,497 | 11/1980 | Meschnig | 411/386 X |
| 4,432,575 | 2/1984 | Garvey et al. | 292/341.19 X |
| 4,616,967 | 10/1986 | Molina | 411/107 X |
| 4,696,500 | 9/1987 | Zunkel | 292/DIG. 60 X |
| 4,802,350 | 2/1989 | Periou | 292/201 X |
| 4,907,233 | 3/1990 | McGrath, Jr. | 411/85 X |

FOREIGN PATENT DOCUMENTS

| | | | |
|---|---|---|---|
| 13674 | 6/1956 | Fed. Rep. of Germany | 292/341.18 |
| 614974 | 10/1926 | France | 292/DIG. 14 |

*Primary Examiner*—Lloyd A. Gall
*Attorney, Agent, or Firm*—Haynes N. Johnson

[57] ABSTRACT

A self-adjusting lock has a keeper stud with a base that is mounted in a recess in a keeper assembly so that it can slide in four directions. As the bevelled keeper stud is pressed into an opening in a latch assembly, the stud self-adjusts in the necessary direction to achieve alignment. A spring pressing the base against a surface causes the base, and so the keeper stud, to be frictionally held in its new position. The keeper stud has a series of spaced ratchet teeth, axially separated from one another, any of which can interengage with the latch mechanism. Thus, the lock is adjusted in this direction each time the lock is closed, resulting in a lock self-adjustable in six directions.

13 Claims, 3 Drawing Sheets

Fig. 1.
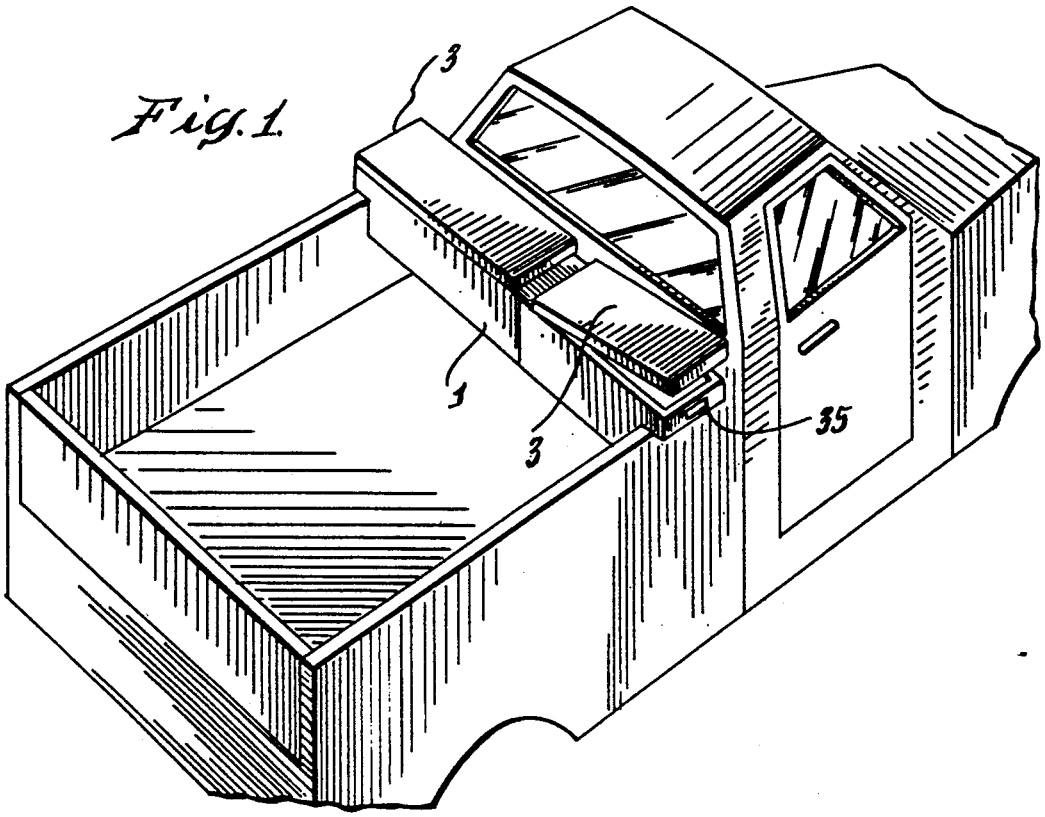
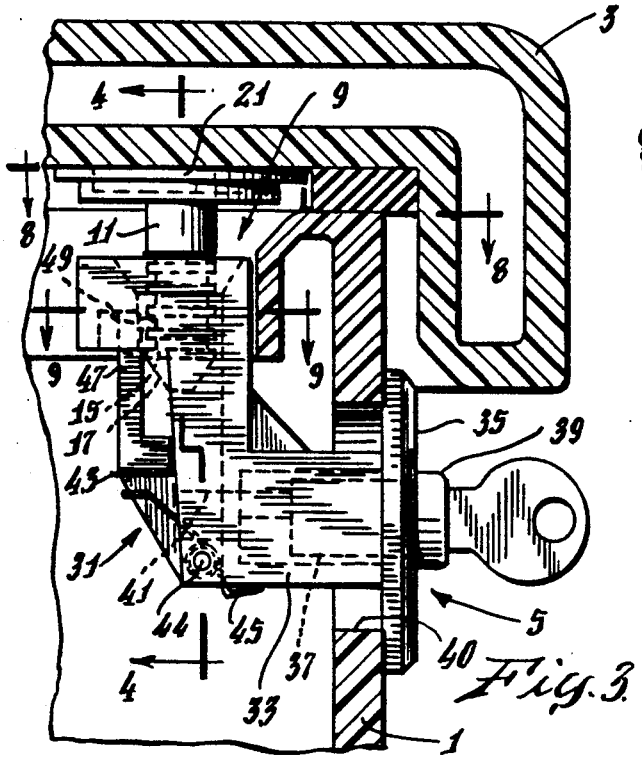
Fig. 3.
Fig. 4.
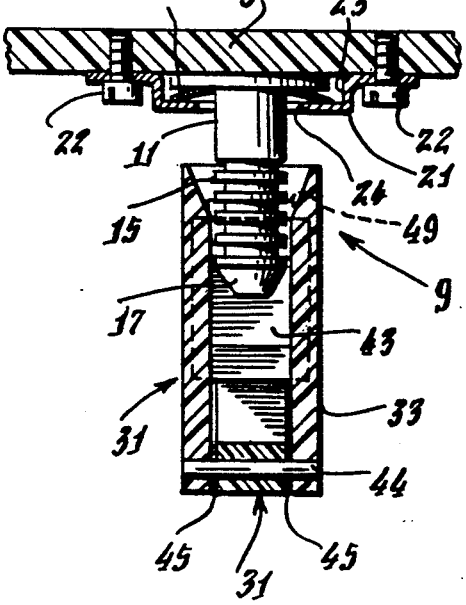

Fig. 8.
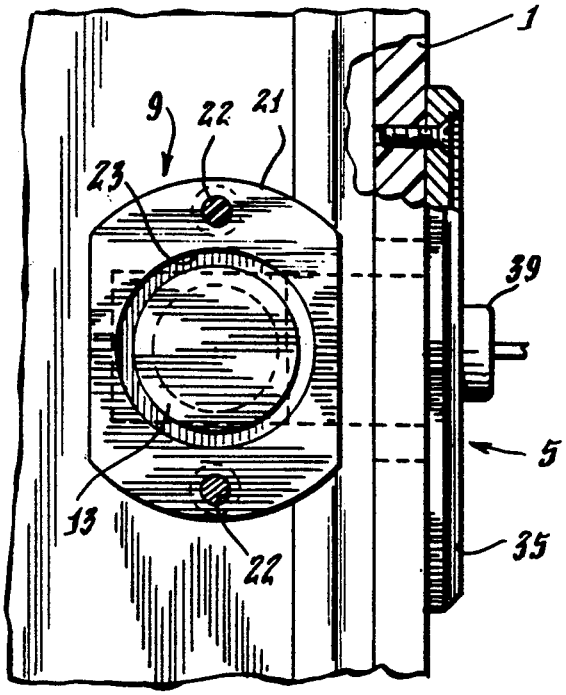
Fig. 10.
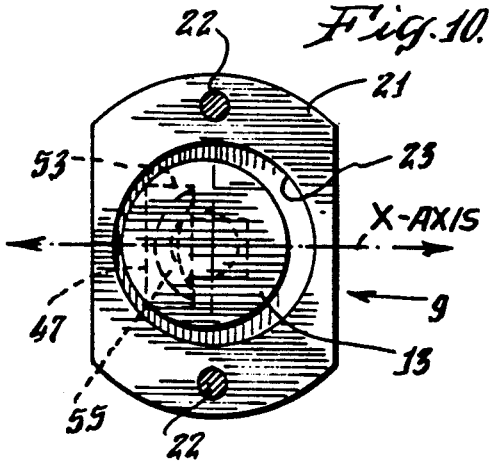
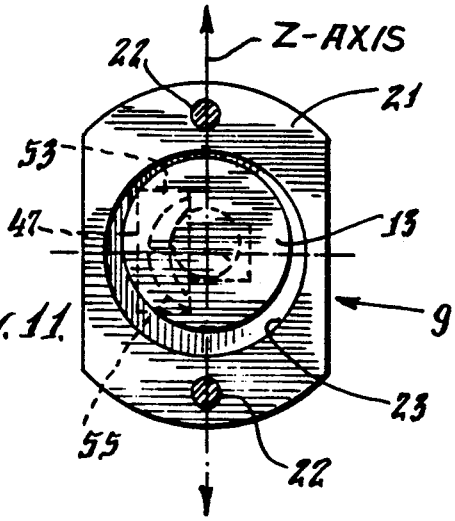
Fig. 11.
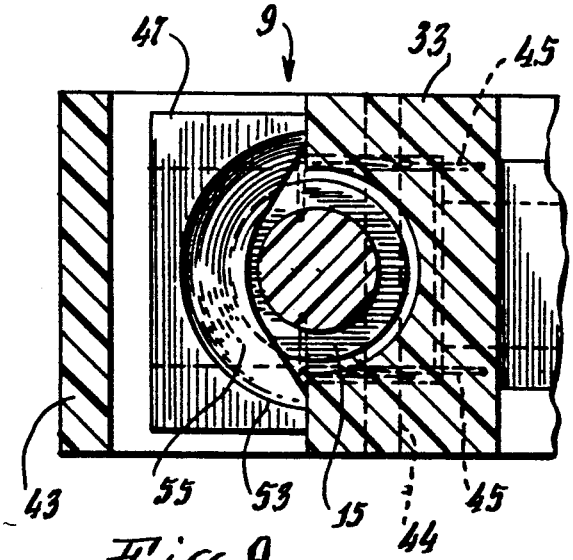
Fig. 9.
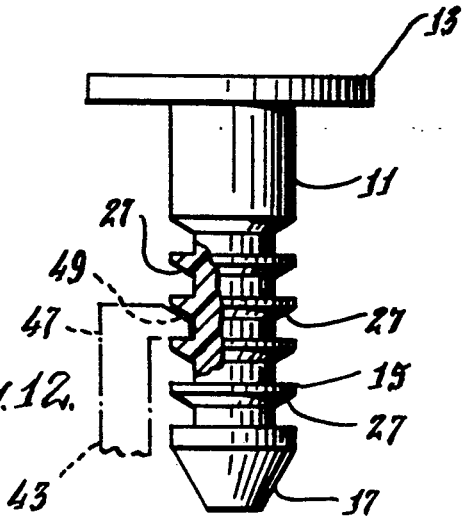
Fig. 12.

SIX-WAY SELF-ADJUSTING LOCK FOR USE ON TRUCK STORAGE BOXES AND THE LIKE

FIELD OF THE INVENTION

This invention relates to self-adjusting locks and, in particular, to locks in which the relative positions of the latch lever and keeper are self-adjusting relative to one another.

BACKGROUND OF THE INVENTION

The installation of locks on devices such as truck storage or tool boxes has been a problem due to manufacturing variances in the box and the cover which is to be locked. These parts do not always have the same dimensions, and there is a certain amount of play and relative movement. Thus, in installing locks one has had to take the time to adjust the relative positions of the latch lever and the keeper to be certain they are in alignment with one another so that they will interfit and latch.

In addition, due to thermal expansion of the materials, abuse, and other causes, these parts can change dimensions during use, and the lock will be thrown out of adjustment. Also there may be times when the box is overfilled and its cover will not quite close; the lock will adjust, however, so that the box can still be locked.

It is the purpose of the present invention to provide a lock which is self-adjusting so that it does not have to be adjusted during manufacture of the units nor adjusted again during use.

An example of a prior art lock with some degree of adjustability will be found in U.S. Pat. No. 4,635,484.

BRIEF SUMMARY OF THE INVENTION

My lock is self-adjusting in six directions, that is, up and down, left and right, and backward and forward.

The lock has a keeper stud with a base that is mounted in a recess in a keeper assembly so that it can slide in four of these directions. The outer end of the keeper stud is bevelled, as is its complementary opening in the latch assembly. As a result, as the keeper stud is pressed into the assembly, the stud self-adjusts in the necessary direction to achieve alignment. A spring pressing the base against a surface causes the base, and so the keeper stud, to be frictionally held in its new position.

In addition, the keeper stud has a series of spaced ratchet teeth, axially separated from one another, any of which can interengage with the latch mechanism. Thus, the remaining two dimensions are adjusted each time the lock is closed, resulting in a lock self-adjustable in six directions.

DESCRIPTION OF THE DRAWINGS

FIG. 1 is a perspective view of a pick-up truck with a lockable of the type in which my lock can be used.

FIG. 3 an elevation of the lock as installed, taken on line 3—3 of FIG. 2.

FIG. 4 is a vertical section of the lock, taken on line 4—4 of FIG. 3.

FIG. 8 is a horizontal section taken on line 8—8 of FIG. 3. Here the base of the keeper stud is centered in the recess of the keeper plate.

FIG. 9 is a horizontal section taken on line 9—9 of FIG. 3.

FIG. 10 is similar to FIG. 8 and shows the base of the keeper stud adjustment along the x-axis.

FIG. 11 to FIG. 10 and shows adjustment of the lock along the z-axis.

FIG. 12 is a vertical elevation, partially broken away, showing a modification of the keeper stud in which the ratchet teeth are bevelled.

DETAILED DESCRIPTION OF THE INVENTION

Figure 5:
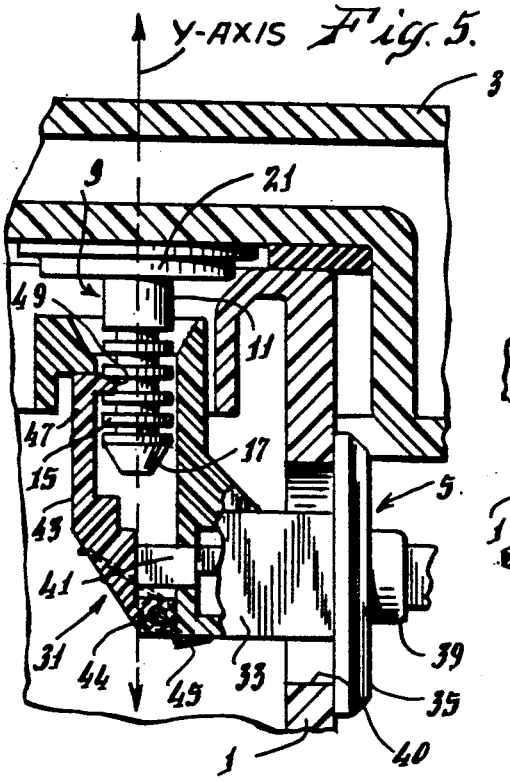
FIG. 5 is a side elevation of the lock, partially broken away, perpendicular to the section of FIG. 4. It shows what I call the y-axis.
Figure 2:
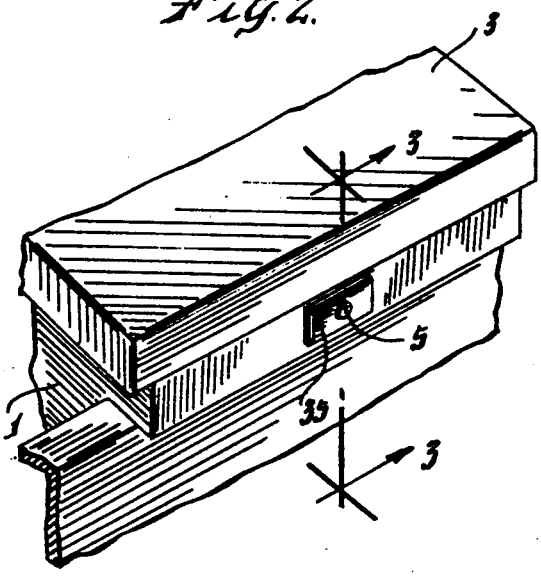
FIG. 2 enlarged perspective of the portion of the tool box which us the lock.
Figure 7:
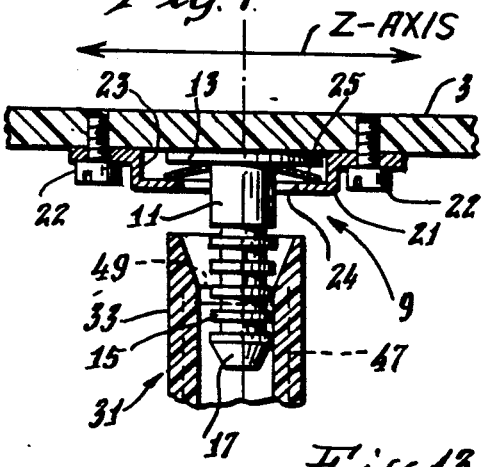
FIG. 7 elevation of the lock, perpendicular to that of FIG. 6, par y broken away, showing the lock after it has adjusted its along the z-axis.

A typical installation for my lock is shown in FIG. 1; the lock is on a storage box in the back of a pick-up truck. The box 1 has a hinged top 3 which is held closed by my lock 5. Since dimensional changes or slightly varied alignments between the box and the top occur, it is useful to have a self-adjusting lock in such an installation.

My lock adjusts on three axes orthogonal to one another. These are x-, y-, and z-axes. Solely for the sake of illustration, I have designated the x-axis as the one parallel to the top 3 and running crosswise of the truck in FIG. 1; the y-axis as perpendicular to the top; and the z-axis as parallel to the top and running lengthwise of the truck. As will appear, the y-axis is axial with the keeper stud of my invention, and the other axes are transverse to the stud axis.

My lock is made up of a floating keeper stud assembly 9, here secured to top 3, and a latch assembly 31, here secured to the side of box 1.

Stud assembly 9 includes round keeper stud 11 integrally molded to base 13 its upper end. Base 13 would normally, but not necessarily, be round and have flat surfaces, but it could have a different shape, for example, to key it against rotation. The stud is transverse to the base and attached at the center of the base. Keeper stud 11 is generally cylindrical with spaced ratchet teeth 15, and its end is bevelled, as shown at 17. The teeth preferably run around the periphery of the stud.

Assembly 9 also includes keeper plate 21 which is screwed to the surface to be locked, here the inside of top 3, by screws 22. Plate 21 has a recess 23 to receive and hold the base 13 between the plate and the surface, and an opening 24 in the recess from which keeper stud 11 projects. Recess 23 is larger than base 13 in the x- and z- directions, and opening 24 is larger than the cross-section of the keeper stud in those directions, so that base 3 and stud 11 are free to move limited distances in those directions.

A metal spring washer (wave washer) 25 is fitted about stud 11 between keeper plate 21 and base 13, and is dimensioned such as to press the base against the surface. The result is that base 13 and keeper stud 11 are normally held by friction against movement, but sidewise pressure against stud 11 will serve to slide the base and stud to a new position.

Figure 13:
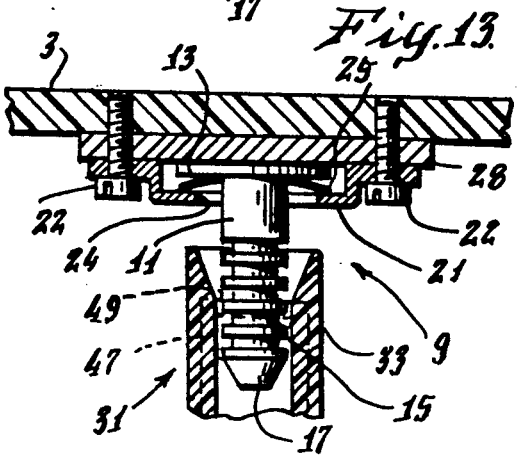
FIG. 13 is similar to FIG. 4, but shows a modification of my invention.

If desired, the keeper assembly can also include a keeper base 28 (FIG. 13) for the keeper plate, so that the friction is against it. This adds cost, but would be useful in instances where the surface to which the keeper assembly is to be secured is uneven or rough.

Figure 6:
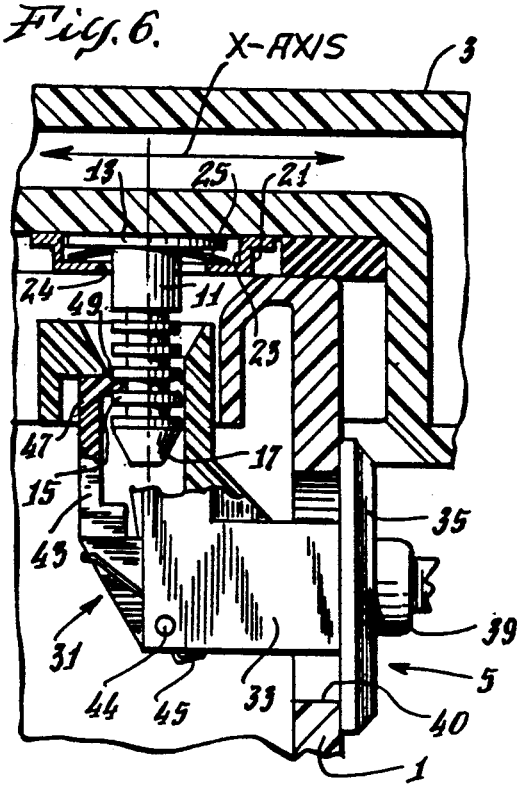
FIG. 6 is a similar elevation of the lock, partially broken away, showing the lock after it has adjusted its position along the x-axis.

Latch assembly 31 includes housing 33 and face plate 35, preferably integrally molded together. Lock cylinder 37 is mounted inside the housing, perpendicular to the face plate, with keyhole button 39 projecting through the face plate. The face-plate is mounted on the box 1, as shown in FIGS. 3 and 6, with the housing projecting through a hole in the box.

The back of housing 33 is open and carries a spring-pressed lever 43 on pivot 44. It is pressed inwardly toward the keeper stud by springs 45, carried by the pivot. The upper end of lever 43 forms a latch 47 with bevelled edge 49. A plunger 41 extends from the lock cylinder to the bottom of lever 43.

The upper portion of the housing is a keeper stud socket 53, with an inwardly bevelled opening 55 to receive keeper stud 11. The lower portion of the bevel is slightly larger than the stud, and the upper portion a good bit wider, since the bevel has an angle of about 45°.

The keeper stud assembly and latch assembly are molded from ABS, Delrin, or polycarbonate plastic. If desired, it can be made of zinc alloy material as a zinc-die-cast part.

As can be seen, when top 3 is lowered to close and lock box 1 keeper stud 11 does not have to be accurately aligned with socket 53. If it is out of alignment, bevel 17 on the stud will press on bevel 55 of the socket, forcing the stud sideways into alignment. Since base 13 is free to move sideways within recess 23 of the keeper plate 21, the stud and the base will move the distance necessary to cause alignment. This, then, will provide for adjustment in the directions of the x-axis and the z-axis, i.e., adjustments in four directions, forward and backward and left and right. The result of a typical adjustment along the x-axis can be seen in FIG. 10, and along the z-axis in FIG. 11. An adjustment could, of course, be in both the x- and z-directions.

It is not necessary for both the stud and the socket to be bevelled. I prefer it this way, however, since it provides for more latitude in adjustment.

Y-axis adjustment, i.e., up and down, results from having the series ratchet teeth 15 on the keeper stud 11. Thus, when closing the top to lock the unit, the stud goes down as far as it can, and the latch 47 engages with the uppermost of the teeth which it reaches. This is facilitated by the bevel 49 on the latch.

Accordingly, the lock is adjustable along all three axes. These adjustments can be as much as one-half inch along each axis. If desired, however, the lock can be made so that it is adjustable in only one or two directions.

A modification is shown in FIG. 12. There, the ratchet teeth 15 are also bevelled at points 27. This allows the latch and teeth to slide by each other more easily when the lock is being engaged.

To release the lock, the key is turned in cylinder 37, releasing the lock, so that button 39 can be pressed. This then moves plunger 41 against the latch 47, so that the latch disengages from the teeth 15 on keeper stud 11, permitting the keeper stud to be removed from the socket. Since the lock was adjusted for proper alignment when initially closed, and since base 13 is held in place by friction, the lock will retain its alignment. If, subsequently, something occurs to get it out of alignment, it will realign itself.

I claim:

1. A self-adjusting lock including a keeper stud assembly and a latch assembly, said keeper stud assembly including a keeper stud, having a transverse base, a keeper plate substantially transverse to the axis of said stud having a recess therein larger than said base and an opening in said keeper plate larger than the diameter of said keeper stud to receive said keeper stud, said recess and said opening being sufficiently large as to permit alignment motion of said keeper stud in directions transverse to the axis of said stud, without changing the angle of said axis, and means to press said base away from said opening, and means to secure said keeper stud assembly to a surface to be locked, said latch assembly including a socket to receive said keeper stud, means to secure said latch assembly to a second surface to be locked, and latch means associated with said socket, and said socket being generally aligned with said keeper stud when said surfaces are brought together, whereby movement of said keeper stud into said socket will cause said keeper stud to move in a direction perpendicular to its axis to align itself with said socket.

2. A self-adjusting lock as set forth in claim 1 including a plurality of axially-spaced teeth on said keeper stud, whereby said latch means can engage with one of said teeth.

3. A self-adjusting lock as set forth in claim 1 in which said keeper stud is bevelled on the end that enters said socket.

4. A self-adjusting lock as set forth in claim 3 in which said socket is bevelled to be complementary to said keeper stud bevel.

5. A self-adjusting lock as set forth in claim 1 including means to release said latch means.

6. A self-adjusting lock as set forth in claim 1 in which said means to press said base away from said opening is a spring washer.

7. A keeper assembly adapted for alignment with a latch, including a keeper plate, a recess in said plate, and an opening in said plate, a keeper stud having a transverse base, ratchet teeth on said stud above said base, said base being sufficiently smaller than said recess to permit alignment movement of said base within said recess, and said stud having a diameter sufficiently smaller than the size of said opening to permit alignment movement of said stud within said opening, said base and said stud being sufficiently smaller than said recess and said opening, respectively, to permit non-tilting alignment motion of said keeper stud in directions transverse to the axis of said stud, said stud passing through said opening with said base being in said recess, and means to press said base away from said keeper plate, whereby said keeper plate is mountable upon a surface with said base pressing against said surface, and said stud is movable relative to said keeper plate transversely of its axis.

8. A keeper assembly as set forth in claim 7 in which the end of said stud remote from said base is bevelled.

9. A keeper assembly as set forth in claim 7 including a keeper base secured to said keeper plate on the side thereof opposite said opening, whereby said base will be pressed against the inner surface of said keeper base.

10. A lock adapted to self-adjust for alignment along three axes, said lock including a keeper stud having an integral transverse base, and an associated keeper plate proximate to said base, means permitting non-tilting adjustment of the position of said keeper stud relative to said keeper plate in directions transverse to the axis of said keeper stud, spring means to hold said keeper stud in said adjusted position, a latch assembly having a socket and self-engaging latching means and being generally positioned such that said socket will receive said keeper stud in a direction axially of said stud when said lock is closed, and means for interengaging said keeper stud and said socket.

11. A lock as set forth in claim 10 in which said means permitting adjustment of said keeper stud include a recess in said keeper plate larger in said transverse directions than said base, an opening in the recess portion of said keeper plate generally central of said recess, said opening being larger in said transverse directions than the transverse dimensions of said keeper stud, and said base being positioned within said recess with said keeper stud projecting through said opening.

12. A lock as set forth in claim 11 in which said means to hold said keeper stud in said adjusted position is a spring washer about said keeper stud and between said base and said keeper plate.

13. A lock as set forth in claim 10 in which said means for interengaging said keeper stud and said socket include a plurality of axially-spaced ratchet teeth on said keeper stud and a detent positioned in said socket for interengagement with said teeth.

* * * * *